United States Patent [19]

Simon

[11] Patent Number: 4,660,991

[45] Date of Patent: Apr. 28, 1987

[54] DEVICE FOR STORING AND SIGNALLING THE TIME FOR TAKING DRUGS

[76] Inventor: Udo Simon, Ziegelsteinstrasse 212, D-8500 Nurnberg 10, Fed. Rep. of Germany

[21] Appl. No.: 826,553

[22] Filed: Feb. 6, 1986

[30] Foreign Application Priority Data

Feb. 9, 1985 [DE] Fed. Rep. of Germany ... 8503564[U]

[51] Int. Cl.[4] ..... G04B 7/00

[52] U.S. Cl. ..... 368/10; 368/109; 368/107; 206/534; 116/308

[58] Field of Search ..... 368/10, 107, 109, 89; 206/534; 116/308; 221/3

[56] References Cited

U.S. PATENT DOCUMENTS 4,526,474 7/1985 Simon ..... 368/10

*Primary Examiner*—Bernard Roskoski

*Attorney, Agent, or Firm*—Collard, Roe & Galgano

[57] ABSTRACT

A device is described for storing and periodically signalling the time for taking drugs, consisting of a drug container in the form of a blister pack and having a signal emitter activated in settable time intervals. The signal emitter is an electric timer having an audio signal emitter and/or an optical signal indicator and an electrically activated input receiving an electrical starting pulse at the time when a first drug dose is removed from the pack. Sensors responding to the removal of the drug doses provide the electrical pulse. The device is designed so that commercially available drug containers may be used without alteration. For this purpose the device has a supporting frame which at least partially encloses the marginal zone or edge of the drug container, and which, owing to its at least partially open design at the bottom, permits dispensing of the drug doses from the drug container which is inserted in the supporting frame. The supporting frame supports the signal emitter as well as the sensors with an arrangement of the sensors conforming to the arrangement of the drug doses in the drug container. The sensors are arranged either on the supporting frame itself or on a sensor support adapted to be inserted in the supporting frame or secured on the frame.

46 Claims, 10 Drawing Figures

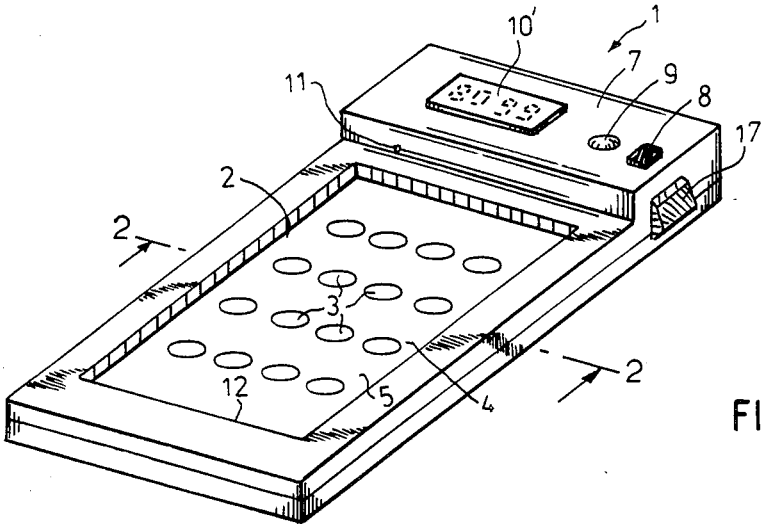
FIG.1
FIG.3
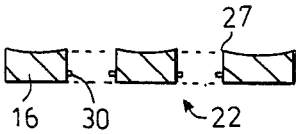
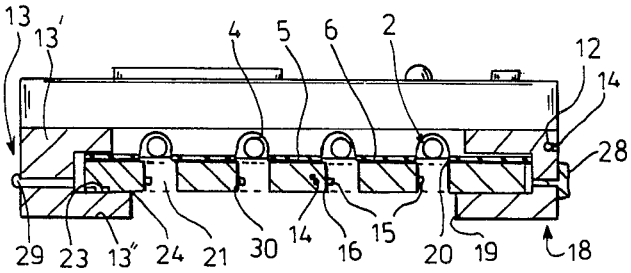
FIG.2

DEVICE FOR STORING AND SIGNALLING THE TIME FOR TAKING DRUGS

The present invention relates to a device for storing and periodically signalling the time for taking drug doses. More particularly, the present invention relates to such a device consisting of a blister pack in which the drug doses in the form of tablets, capsules or pills are individually sealed between a first foil having molded pockets for the pills and a second rupturable foil glued or fused to the first foil, and a signal emitter for emitting audio and/or optical signals. The signal emitter includes an electronic timer system activated at adjustable time intervals and a starting pulse input means including sensors for electric activation and feeding of an electric starting pulse to the timer system when a drug dose is removed.

A device of the type described above is disclosed in my earlier U.S. Pat. No. 4,526,474, granted July 2, 1985. Basically, the device disclosed in my previous patent has a signalling system associated with a blister pack containing drug doses, in the form of tablets, capsules or pills or the like, which alerts the user to the correct time for taking the drug doses. The timer system of this device is equipped with a setting input, which is actuated each time a pill is pushed through the rupturable foil of the blister. This is achieved by means of a conductor line or sensor placed across the rupturable zone of the foil. When this zone is ruptured, the conductor line is separated, causing a pulse to be supplied to the timer system. Details relating to the circuit of the timer system as well as details pertaining to the conductor lines and their design are contained in the above-identified patent. All of these details can also be advantageously used in connection with the present invention and thus the disclosure contained in the above-identified patent is incorporated herein by reference.

The device disclosed in the above-identified patent has drawbacks in that the blister pack itself must be provided with electrical lines or leads applied thereto by vapor deposition or printing, which causes the manufacture and packaging of the drug itself to be slightly more expensive. Also, this feature requires a very expensive refitting of the packaging machines used in the pharmaceutical industry. Such a costly refitting however is unnecessary in many cases since not all drug blister packs can be or need be used with a timer system controlled in this manner.

It is, therefore, an object of the present invention to provide a device for storing and signalling the time for taking drugs having a design such that the signal emitter signalling the time for taking the drug can be controlled by the removal of the drug dose from a standard blister pack without the need to change the blister pack itself in any way.

The underlying feature of the present invention is that, contrary to the state of the art in this field, the signal emitter and the sensors cooperating therewith are not secured directly on or formed integrally with the drug pack but are rather supported in a supporting frame holding the signal emitter and the sensors. The term supporting frame is used herein to indicate that the frame serves to hold or support the sensors and the signal emitter on the drug package. Another important feature is that the supporting frame is designed so that pills or tablets can be removed from the drug container even though the container is fastened in the frame. For this purpose, the frame is partially open at least on its bottom side, so that the pills can be dispensed from this side. The top side of the frame may either be open, in which case the pills are dispensed by directly applying finger pressure to the protrusions of the first foil, or a cover plate with flexible elements may be provided by means of which pressure can be indirectly applied to the protrusions in order to dispense or eject the pills from the pack.

By means of the present invention it is possible to fit finished drug containers, i.e. containers with their packaging completely finished, with a signal emitter without altering the finished container in any way, so that by means of the signal emitter the removal of drug doses from the pack can be precisely controlled. The sensors for actuating the signal emitter can be arranged directly on the supporting frame or secured on a separate sensor support adapted to be inserted in the frame or secured thereon.

Containers for pills or tablets in the form of blister packs are available in a large variety of different dimensions with different numbers of pills contained therein and with different spatial arrangements. It is therefore advantageous if the signal emitter, comprising the parts which are more manufacturing and cost intensive, is detachably mounted on the supporting frame and different frame sizes with different sensor arrangements are provided for the variety of blister packs. The supporting frame, unlike the relatively costly electronic timer system, is an inexpensive article which may be supplied by the drugstore to the customer together with the matching drug package without any excessive additional cost as long as the customer already has the signal emitter matching the frame.

By providing a support plate with recesses disposed on the bottom side of the drug container, the removal of the pills by forcing them through the rupturable foil and the respective recess is facilitated, on the one hand, without fear that the entire blister pack, which, as a rule, is flexible, is forced out of the frame. On the other hand, the sensors may be secured or fastened on this support plate so that the support plate is also the support holding the sensors. If the support plate is a separate plate adapted to be detached from the frame, one standard frame can be used for a variety of blister packs since the support plate serves as an adapter for the different blister packs. To assure trouble-free electrical contact between the frame, signal emitter and in particular the support plate, the support plate is provided with contacts connected to the leads or lines leading to the sensors. In operation, these contacts act on correspondingly arranged, fixed contacts of the frame or signal emitter.

A very simple manner of mounting a drug containing blister pack in the frame or support plate involves the provision of inwardly directed grooves along the sides thereof for slidingly receiving the blister pack. Furthermore, it may be advantageous to provide the support plate with cutting edges surrounding the recesses through which the drug doses are ejected, thereby preventing excessive tearing of the rupturable second or additional foil of the drug package.

Advantageously, the supporting frame consists of a bottom part and a top part, the top part, in the ready-to-use position, being retained on the bottom part by means of a snap-lock connection, covering the drug container along the edges thereof. Thus, the drug container is supported and firmly retained in the frame and the entire device can be easily handled particularly if the top and bottom parts are fastened to each other by means of a hinge-type connection. Such a hinge may be a plastic film-type hinge.

Different types of sensor elements may be fastened on the supporting frame or cooperating therewith to provide the pulse for signalling the ejection of a drug dose. By way of example, the sensors may be provided in the form of small mechanical switches arranged on the support plate or in the interior of the plate. On the other hand, a stationary contact may be provided, for example a ring contact, within the zone of the opening through which the pill is ejected, thereby exploiting the metallic and thus conductive properties of the commonly used rupturable foils of the blister pack. In this case a section of the metallic blister foil is torn, so that it is suspended downwardly from the plane of the blister pack to make contact with the ring contact and thus close the circuit to produce a signal pulse.

The sensors may also be provided in the form of separable conductor line sections, or lead sections, arranged on a partially rupturable separate foil adapted to be inserted or attached beneath the drug container. With respect to the design and circuitry of such conductor lines or leads, reference is made to my U.S. Pat. No. 4,526,474 discussed above. All features of this patent relating to the leads or lines and circuitry and the like may be advantageously used with the present invention.

In another embodiment of the present invention, the sensors are electrical push buttons arranged on the side of the blister pack which is provided with the protrusions for the drug doses. By means of ejection elements, the push buttons act on the protrusions of the blister in the direction of ejection. These push buttons have a double function in that they serve as pressure producing elements to cause the pills to be urged or forced through the rupturable second foil on the one hand, while serving also as electric switching means on the other. The sensors may be arranged in the form of these push buttons in or on a separate support plate, so that the sensors can be adapted to the size of the blister pack and the arrangement of the pills therein, or the push buttons can be arranged in a support plate integrally formed with the frame.

In another embodiment, the sensors are arranged on or within the zone of the bottom side of the support plate, or are supported by a bottom of the supporting frame. For aesthetic or functional reasons it may be advantageous to close the supporting frame on its bottom side, so that the device is substantially closed. To remove a drug dosage, the lid of the container is opened, exposing the sealed pills, so that said pills may be forced through the foil. In this case, the bottom side of the blister pack rests on a support plate beneath which plate the sensors are arranged in such a way that the sensors respond each time a pill is forced through the opening of the support plate associated with the pill or through the associated opening of any other type of supporting device (conceivably, a plurality of supporting projections may be provided projecting upwardly from the bottom of the frame against the bottom side of the blister pack to support the pack). Conceivably, a large number of different sensors may be used based on different physical-technical modes of operation, such as pressure sensors embedded in a flexible and compressible layer. If the sensors are push buttons, it may be advantageous to cover the sensors with a flexible layer in order to avoid damage to the pills when they are dispensed, i.e., damage caused by sharp projections of the push button arrangement. It is important that when a pill is dispensed, only the push button or sensor associated with that pill responds. This can be achieved, for example, by providing the flexible layer with molded pressure-transmitting projections protruding in the direction of the associated pill. When the pill is ejected, the associated projection is either displaced in the direction of the sensor, or tilted sideways, causing the sensor to respond.

Furthermore, it may be advantageous to provide the element supporting the sensors under the pills, i.e., the sensor support, with at least one pill ejection opening in order to assure that the pill is not jammed and possibly damaged between the blister support plate and the sensor support.

With sensors which include contacts which close when a pill is dispensed, the leads leading to the sensors may extend like a net under the switches. In this way, a line lead and a column lead is associated with each sensor line and each sensor column (provided, of course, the sensors are arranged like a matrix), so that when a sensor, for example a push button, is actuated, both leads associated with the push button sensor are acted upon. For example, with an $n \times m$-matrix arrangement, it is possible to use only $n+m$-lines, which significantly simplifies the line configuration (for example: with thirty sensors arranged in six lines and five columns, eleven lines leading to the signal emitter are sufficient to localize the response of each individual sensor). This is an advantage especially when a pack contains pills with different durations of action and the time intervals of the signal emitter are to be automatically set depending on the duration of action of a pill dispensed from the pack.

Also, it may be advantageous to provide the setting device for the signal emitter in the form of additional keying circuits, which may be arranged on a plate of the frame in a way similar to the arrangement of the push buttons. In order to avoid any change in the setting of the signal emitter (i.e. the timer system) due to unintentional actuation of the setting keying circuit, it is advantageous if the function of these keying circuits can be switched off when the device is not in use.

In order to allow the treating physician to control and reproduce a prescribed dosage taking cycle, the signal emitter may be provided with a memory for storing the times when pills are removed from the pack, so that these times can be reproduced on a display of the signal emitter or by a separate output unit connected to an output of the signal emitter.

Also, the signal emitter may be provided with indicator means for indicating when the taking of a drug dose has been missed, which may be achieved by a flashing light signal or an intermittently generated audio signal reminding the user to take a pill. Such a signal may be emitted at regular intervals, such as every 10 minutes in order to save electric energy.

Other objects and features of the present invention will become apparent from the following detailed description considered in connection with the accompanying drawings. It is to be understood, however, that the drawings are designed as an illustration only and not as a definition of the limits of the invention.

In the drawings wherein similar reference characters denote similar elements throughout the several views:

FIG. 1 is a perspective view of a device according to the present invention;

FIG. 2 is a cross-sectional view of the device according to the present invention taken along line II—II of FIG. 1;

FIG. 3 is a cross-sectional detail view of part of a support plate provided with rupturable pockets utilized in the device of FIG. 1;

Figure 5:
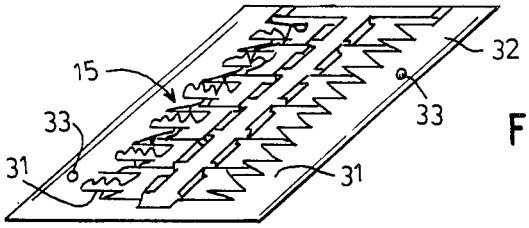
Figure 6:
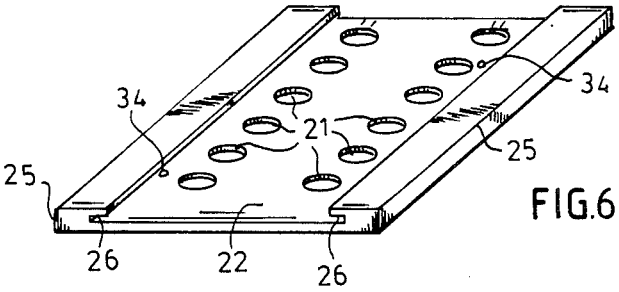
Figure 7:
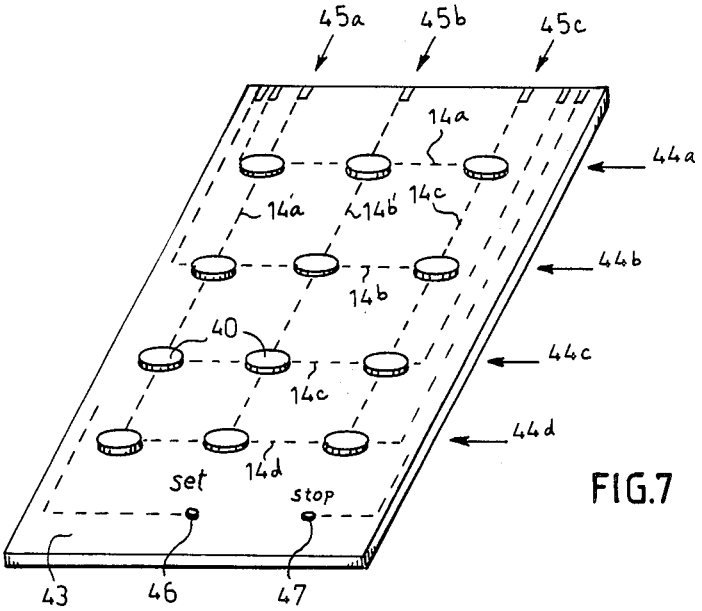
Figure 8:
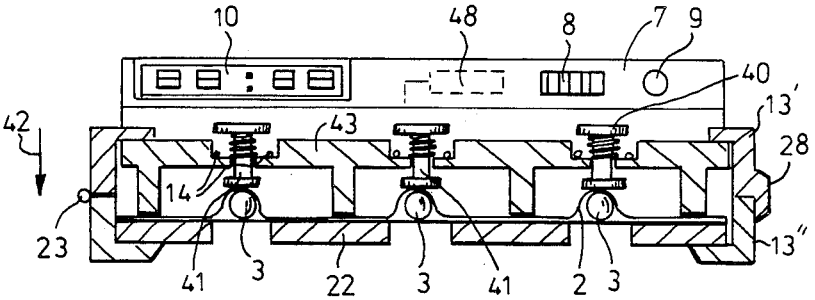
Figure 9:
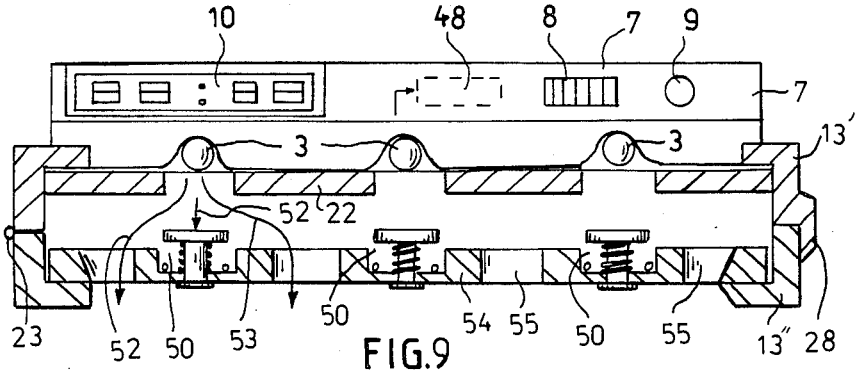
Figure 10:
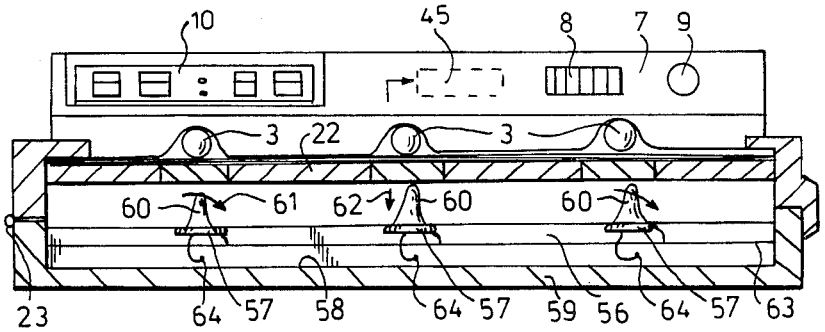

FIG. 5 a perspective view of a sensor support in the form of a separate rupturable foil;

FIG. 6 is a perspective view of another embodiment of a support plate utilized in the device of the present invention;

FIG. 7 is a perspective view of a sensor support fitted with push buttons;

FIG. 8 is a cross-sectional view of another embodiment of the device of the present invention, using the sensor support of FIG. 7;

FIG. 9 is a cross-sectional view of yet another embodiment of the device of the present invention, with the sensors arranged beneath the blister pack; and FIG. 10 is a cross-sectional view of yet another embodiment of the device of the present invention similar to that shown in FIG. 9.

Now turning to the drawings, there is shown in FIG. 1 a device 1 for storing and signalling the time for taking drugs (in the form of pills, tablets or capsules) contained in a drug container 2 in the form of a blister pack for tablets or pills 3. Tablets 3 are sealed in container 2 by being fused between a first foil 5 provided with protrusions forming drug receiving pockets or blister pockets 4 and a rupturable second or additional foil 6. Furthermore, device 1 is provided with a signal emitter 7 which is activated in settable or adjustable time intervals and which is in the form of an electric timer having an audio signal emitter 8, an optical signal indicator 9, a display 10 and an electrically activated input take-off 11. When a tablet 3 is removed from drug container 2 for the first time, take-off input 11 is supplied with an electric starting pulse, for which purpose sensors responding to the removal of tablets 3 are provided.

As clearly seen in FIG. 2, signal emitter 7 is arranged on a supporting frame 13 which at least partially encloses marginal zone 12 of drug container 2. Because of its at least partially open bottom design, frame 13 permits tablets 3 to be forced out of or ejected from drug container 2 placed in the frame. Frame 13 supports part of the electrical lines 14 leading from signal emitter 7 to sensors 15 which are arranged either directly on frame 13 or on a sensor support 16 adapted to be attached on supporting frame 13.

Signal emitter 7 is detachably secured on supporting frame 13 by means of a snap-lock connection 17. The input-output contacts of signal emitter 7 act on complementary contacts arranged on supporting frame 13 and which are connected to leads 14 on supporting frame 13.

On its bottom side 18, supporting frame 13 is provided with a receding edge 19, which partially covers the bottom side 20 of drug container 2 at marginal zone 12 thereof.

As further seen in FIG. 2, a support plate 22 provided with rupturable recesses 21 for dispensing tablets 3 is arranged between receding edge 19 and bottom side 18 of supporting frame 13. Support plate 22 is also shown as forming a sensor support 16. It is also possible within the scope of the present invention to form bottom part 13" of frame 13 integrally with support plate 22.

Sensors 15 are secured on support plate 22 within recesses 21 for dispensing tablets 3. Support plate 22, having lines 14 leading to sensors 15, is provided with contacts 23 which electrically communicate with lines 14. In operation, contacts 23 communicate with complementary contacts 24 arranged on supporting frame 13.

As clearly seen in FIG. 3, support plate 22 may be provided with cutting edges 27 surrounding recesses 21 for dispensing tablets 3. This permits the clean cutting of foil 6 as a tablet 3 is dispensed.

Supporting frame 13 consists of a top frame part 13' and a bottom frame part 13", top part 13' being retained on bottom part 13" by means of snap-lock connection 28. Top and bottom parts 13' and 13" are fastened or connected to each other by means of a hinge-type connection 29.

Figure 4:
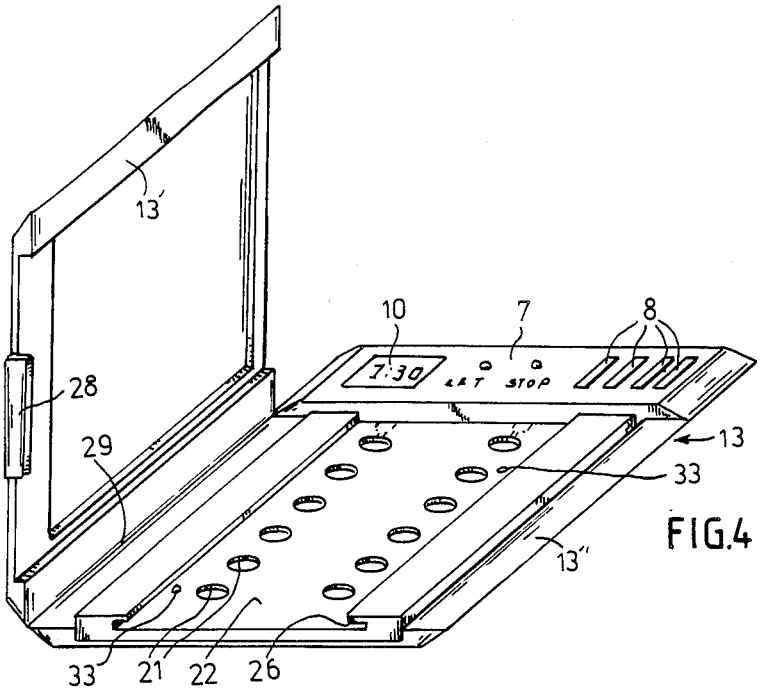
FIG. 4 is a perspective view of another embodiment of the device according to the present invention.

In the embodiment shown in FIGS. 4 and 6, support plate 22 is provided on its opposing longitudinal sides 25 with inwardly open, U-shaped grooves 26 for receiving the lateral edges of drug container 2.

Several different types of sensors 15 may be utilized in connection with device 1. In the embodiment shown in FIG. 2, sensors 15, which are secured in support plate 22, have detecting elements 30 which project into recesses 21 and into the path in which tablets 3 are ejected. Detecting element 30 may be a pressure pin, pivotable tongue or the like cooperating with an electrical contact. Furthermore, detecting element 30 may be provided in the form of a stationary contact arranged in recess 21 for dispensing the tablet, wherein the stationary contact is acted upon by a section of foil 6 projecting into the recess subsequent to the dispensing of tablet 3 and which is partly or completely torn when the tablet is dispensed.

In the embodiment shown in FIG. 5, sensors 15 are provided in the form of separable line sections 31 which are arranged on a partially rupturable separate foil 32 which is adapted to be inserted under drug container 2. These line sections may be arranged on foil 32 by vapor deposition, printing, adhesion and the like. Separate foil 32 is retained in device 1 by being clamped between drug container 2 and support plate 22. Separate foil 32 may also be provided with a locating means which may include at least one retaining and adjusting recess 33, which cooperates with a retaining and adjusting pin 34 on frame 13 or on support plate 22. Separate foil 32 may be formed as a rupturable second or additional foil of drug container 2 and/or a self-adhesive foil adapted for adhering to support plate 22 or drug container 2.

In the embodiment shown in FIGS. 7 and 8, the sensors are provided in the form of electrical push buttons 40, which are arranged on the side of the blister pack provided with the protrusions forming blister pockets 4 for receiving tablets 3. By means of ejection elements, such as tappets 41, push buttons 40 act on blister pockets 4 of drug container 2 in the direction of ejection, i.e. arrow 42. In the embodiment shown, push buttons 40 are arranged on a separate support plate 43. However, it is also possible to arrange push buttons 40 on a plate-like support formed integrally with top part 13' of supporting frame 13.

As clearly seen in FIG. 7, the sensors, i.e. push buttons 40, are arranged as a matrix above a corresponding arrangement of tablets. In this case, it is suggested that lines 14 extend beneath the push buttons like a net in that each push button line 44*a, b, c* and *d* is associated with a line lead 14*a* to 14*d*, and each push button column 45*a*, 45*b* and 45*c* is associated with a column line or lead 14*a*', 14*b*' and 14*c*', so that when a sensor is actuated, i.e. push button 40 in FIG. 7, both lines or leads (e.g. 14*c*, 14*b*') associated therewith are acted upon.

In addition, support plate 43 is provided with an adjusting means (for example a setting means) for signal emitter 7, these means being provided with input elements forming an additional keying circuit 46, 47, whose function can be switched off by means of a switching device not shown in the drawings.

In the device shown in FIG. 9 (where the elements conforming to the embodiment of FIG. 8 are identified by the same reference numerals), sensors 50 are arranged within the zone of the bottom side 51 of support plate 22. Sensors 50 are provided in the form of electrical push buttons, which, however, are not directly actuated by the user, but by tablets 3 as they are forced out of the pack and dispensed. This is shown by the direction arrows 52 and 53 in FIG. 9. Tablet or pill ejection openings 55 are provided in sensor support 54 in order to assure that the tablets will directly drop from the device when forced out of the pack.

In the embodiment of the present invention shown in FIG. 10, the sensors are provided in the form of pressure sensors 57, which are embedded in a flexible and compressible layer 56. Layer 56 is arranged on side 58 facing the blister pack of a substantially closed frame bottom 59. Pressure-transmitting projections 60 are arranged on flexible layer 56. When the tablets are forced out, projections 60 are displaced or tilted either in the direction indicated by arrow 61 or in the direction 62 in which the tablet is ejected, causing the emission of a signal by sensor 57 over a matrix-like network of line leads 63 and column leads 64, said network corresponding to the arrangement of the tablets in the blister pack. Leads 63 and 64 are embedded in the flexible and compressible layer 56. In the embodiment shown in FIG. 10, the opening for ejecting the tablets is disposed in a lateral surface of the frame but is not shown in the drawing.

Signal emitter 7 (the timer) has a memory 48 for storing the times of drug dispensing or removal from the pack, so that the times of tablet removal are reproducible on display 10 or by a separate output unit adapted to be connected to an output (not shown) of emitter 7. Also, emitter 7 may be provided with switching means controlling a separate indicator device if a pill or tablet is taken or removed from the pack at the wrong time, or which serves to indicate or display on display 10 a defined symbol in order to alert the user to the fact that the taking of a pill was missed.

While a few embodiments of the present invention have been shown and described, it will be obvious that many changes and modifications may be made thereunto without departing from the spirit and scope of the invention.

What is claimed is:

1. In a device for storing and periodically signalling the time for taking drug doses, consisting of a drug container having a marginal zone and which is in the form of a blister pack in which the drug doses are individually sealed between a first foil provided with molded pockets for receiving the individual doses and a second rupturable foil, and a signal emitter activatable in selectable time intervals, said signal emitter being in the form of an electric timer with a signal indicator and having an electrically activatable starting input means which receives an electric starting pulse when a drug dose is removed for the first time, said starting pulse being provided by means of sensors which respond to the removal of the drug doses, the improvement comprising:

a supporting frame having at least a partially open bottom which at least partially encloses the marginal zone of the drug container inserted therein, said frame permitting the drug doses to be dispensed from the drug container through said at least partially open bottom of said frame, said frame supporting the signal emitter and at least part of the electrical leads to the sensors, the arrangement of said sensors being adapted to conform to the arrangement of drug doses in said drug container and said sensors being disposed on said supporting frame.

2. The device as defined in claim 1, wherein the signal indicator of said signal emitter is an audio signal emitter.

3. The device as defined in claim 1, wherein the signal indicator of said signal emitter is an optical signal emitter.

4. The device as defined in claim 1, wherein the signal indicator of said signal emitter is an audio signal emitter and an optical signal indicator.

5. The device as defined in claim 1, wherein said sensors are disposed on a sensor support adapted to be inserted in and fastened onto said supporting frame.

6. The device as defined in claim 1, wherein said signal emitter is detachably secured on said supporting frame by means of a snap-lock connection, and input-output contacts are arranged on the signal emitter to engage with complementary contacts disposed on the supporting frame, said complementary contacts communicating with the electrical leads in the supporting frame for the sensors.

7. The device as defined in claim 1, wherein the supporting frame is provided with a receding edge on its bottom side which partially covers the bottom side of the drug container having the rupturable foil at the marginal zone thereof.

8. The device as defined in claim 1, which further comprises a support plate with rupturable recesses for ejection of the drug doses therethrough disposed on the bottom side of said drug container.

9. The device as defined in claim 1, wherein the bottom part of said supporting frame is formed integrally with a support plate provided with rupturable recesses for the ejection therethrough of the drug doses.

10. The device as defined in claim 8, wherein said sensors are secured on said support plate within the zone of the rupturable recesses.

11. The device as defined in claim 9, wherein said sensors are secured on said support plate within the zone of the rupturable recesses.

12. The device as defined in claim 10, wherein said support plate is provided with electrical leads to the sensors and contacts communicating with said leads, said contacts cooperating with complementary contacts correspondingly disposed on said supporting frame.

13. The device as defined in claim 8, wherein said support plate is provided on opposing longitudinal sides thereof with inwardly open, U-shaped grooves for receiving the lateral edges of said drug container.

14. The device as defined in claim 8, wherein said support plate is provided with cutting edges surrounding the rupturable recesses.

15. The device as defined in claim 9, wherein said support plate is provided with cutting edges surrounding the rupturable recesses.

16. The device as defined in claim 1, wherein said supporting frame comprises a bottom part and a top part, said top part being retained on said bottom part by means of a snap-lock connection and covering said drug container along the marginal edge thereof.

17. The device as defined in claim 16, wherein said top part of said supporting frame is secured to said bottom part by a hinge-type connection.

18. The device as defined in claim 10, wherein said sensors are comprised of detecting elements projecting into the path of the drug dose through the respective recess in said support plate upon ejection thereof.

19. The device as defined in claim 18, wherein each said detecting element is in the form of a pressure pin which cooperates with an electrical contact.

20. The device as defined in claim 18, wherein each said detecting element is in the form of a pivotal tongue which cooperates with an electrical contact.

21. The device as defined in claim 18, wherein each said sensor is in the form of a stationary contact arranged in a respective rupturable recess of said support plate, said stationary contact being acted upon by a foil section of the second rupturable foil of said drug container rupturing on application of pressure, said foil section forming a countercontact projecting into the rupturable recess.

22. The device as defined in claim 8, wherein said sensors are separable pulse line sections arranged on a partially rupturable separate foil adapted to be inserted beneath the drug container.

23. The device as defined in claim 22, wherein said pulse line sections are attached to said separate foil by means of vapor deposition.

24. The device as defined in claim 22, wherein said pulse line sections are attached to said separate foil by means of printing.

25. The device as defined in claim 22, wherein said pulse line sections are attached to said separate foil by means of adhesion.

26. The device as defined in claim 22, wherein said separate foil is clamped between said drug container and said support plate.

27. The device as defined in claim 22, wherein said separate foil further includes at least one retaining-setting recess and said support plate further includes a retaining-setting projection, said retaining-setting recess and projection cooperating with each other to retain and set said separate foil in said support plate.

28. The device as defined in claim 22, wherein said separate foil is in the form of a self-adhesive foil adapted to be adhered to the rupturable second foil of said drug container.

29. The device as defined in claim 22, wherein said separate foil is in the form of a self-adhesive foil adapted to be adhered to said support plate.

30. The device as define in claim 1, wherein said sensors are in the form of electrical push buttons disposed on the side of said drug container having said molded pockets, said push buttons cooperating with ejection elements to act on said pockets to eject said drug doses.

31. The device as defined in claim 8, wherein said sensors are disposed within the zone of the bottom side of said support plate.

32. The device as defined in claim 1, wherein the bottom of said supporting frame is substantially closed and said sensors are disposed thereon facing said drug container.

33. The device as defined in claim 32, wherein said sensors are pressure sensors embedded in a flexible and compressible layer.

34. The device as defined in claim 33, wherein said sensors are covered by a flexible layer.

35. The device as defined in claim 34, wherein said flexible layer includes pressure-transmitting projections molded thereon.

36. The device as defined in claim 8, which further includes a separate sensor support disposed beneath said support plate and on which said sensors are arranged.

37. The device as defined in claim 31, wherein said sensors are interconnected by a matrix-like network of line leads and column leads.

38. The device as defined in claim 32, wherein said sensors are interconnected by a matrix-like network of line leads and column leads.

39. The device as defined in claim 36, wherein said separate sensor support is provided with at least one opening for ejecting said drug doses.

40. The device as defined in claim 30, which further includes a separate support plate for supporting said electrical push buttons.

41. The device as defined in claim 30, wherein said sensors are in a substantially matrix-like arrangement, wherein the leads extend beneath the push buttons so that a line and column lead is associated with each push button line and each push button column, and both leads associated with a sensor are acted upon on actuation of the respective push button.

42. The device as defined in claim 1, wherein said signal emitter further includes a setting means and input elements in the form of additional keying circuits are connected to said setting means.

43. The device as defined in claim 42, wherein the function of said additional keying circuits can be switched off.

44. The device as defined in claim 1, which further includes a memory in said signal emitter for storing the times at which drug doses are dispensed from the drug container, and a display for displaying said times of drug dispensing.

45. The device as defined in claim 44, which further includes a separate output unit connectable to said signal emitter for displaying said times.

46. The device as defined in claim 1, wherein said signal emitter further includes indicator means for indicating that the taking of a drug dose has been missed.

* * * * *